US005640824A

United States Patent [19]

Johnson et al.

[11] Patent Number: 5,640,824

[45] Date of Patent: *Jun. 24, 1997

[54] BUILDINGS AND BUILDING COMPONENTS

[76] Inventors: Ronald K. Johnson, 115 Saddle Ridge, Portage, Wis. 53901-9772; William M. Garrison, 1910 Thackeray Rd., Madison, Wis. 53704

[ * ] Notice: The term of this patent shall not extend beyond the expiration date of Pat. No. 5,390,466.

[21] Appl. No.: 307,683

[22] PCT Filed: Apr. 5, 1993

[86] PCT No.: PCT/US93/03190

§ 371 Date: Sep. 22, 1994

§ 102(e) Date: Sep. 22, 1994

[87] PCT Pub. No.: WO93/20299

PCT Pub. Date: Oct. 14, 1993

Related U.S. Application Data

[63] Continuation-in-part of Ser. No. 862,813, Apr. 3, 1992.

[51] Int. Cl.[6] ..... E04C 2/34; E04B 2/00

[52] U.S. Cl. ..... 52/731.1; 52/404.1; 52/783.14; 52/798.1; 52/800.1; 52/784.11; 52/787.11; 52/284; 52/293.3

[58] Field of Search ..... 52/309.7–309.16, 52/284, 293.3, 783.11, 783.13, 783.14, 784.11, 794.1, 787.11, 798.1, 800.1, 730.1, 731.1, 404.1

[56] References Cited

U.S. PATENT DOCUMENTS

| | | | |
|---|---|---|---|
| 1,637,497 | 8/1927 | O'Dowd . | |
| 2,117,397 | 5/1938 | Bonsall . | |
| 2,297,609 | 9/1942 | Clark et al. . | |
| 3,092,247 | 6/1963 | Woodruff . | |
| 3,184,013 | 5/1965 | Pavlecka . | |
| 3,196,499 | 7/1965 | Houvener | 52/794.1 |
| 3,332,170 | 7/1967 | Bangs . | |
| 3,834,096 | 9/1974 | Becker . | |
| 3,920,603 | 11/1975 | Stayner et al. . | |
| 3,949,529 | 4/1976 | Porter | 52/730.1 X |
| 4,027,401 | 6/1977 | Fairbanks, Jr. . | |
| 4,028,134 | 6/1977 | Stayner et al. . | |
| 4,158,938 | 6/1979 | Meechan et al. . | |
| 4,216,136 | 8/1980 | Stayner . | |
| 4,221,087 | 9/1980 | Lowe | 52/293.3 X |
| 4,282,687 | 8/1981 | Teleskivi . | |
| 4,295,312 | 10/1981 | Campbell . | |
| 4,309,853 | 1/1982 | Lowe . | |
| 4,566,242 | 1/1986 | Dunsworth . | |
| 4,567,100 | 1/1986 | Pickett et al. . | |
| 4,571,909 | 2/1986 | Berghuis et al. . | |
| 4,571,915 | 2/1986 | Barman . | |
| 4,641,468 | 2/1987 | Slater . | |
| 4,641,469 | 2/1987 | Wood . | |
| 4,741,139 | 5/1988 | Campbell . | |
| 4,748,790 | 6/1988 | Frangolacci | 52/794.1 |
| 4,754,587 | 7/1988 | Glaser . | |
| 4,822,657 | 4/1989 | Simpson . | |
| 4,837,999 | 6/1989 | Stayner . | |
| 4,936,069 | 6/1990 | Hunter et al. . | |
| 4,961,298 | 10/1990 | Nogradi . | |
| 5,056,290 | 10/1991 | Alexander et al. . | |
| 5,245,809 | 9/1993 | Harrington | 52/309.11 |
| 5,390,466 | 2/1995 | Johnson et al. | 52/796 |

*Primary Examiner*—Robert Canfield

*Attorney, Agent, or Firm*—Teresa J. Welch; Stroud, Stroud, Willink, Thompson & Howard

[57] ABSTRACT

This invention provides bridge girt assemblies, and modular building panels, for use in fabricating walls, floors and roofs of buildings. The panels have novel structures adapted to protect the interior of the building from intrusion of heat and cold, and/or from fire, and/or from small arms gunfire. Some embodiments also provide mechanical reinforcing connections between the building structural members and the outside of the building. The modular panels can be made entirely with noncombustible materials.

25 Claims, 7 Drawing Sheets

FIG. 2
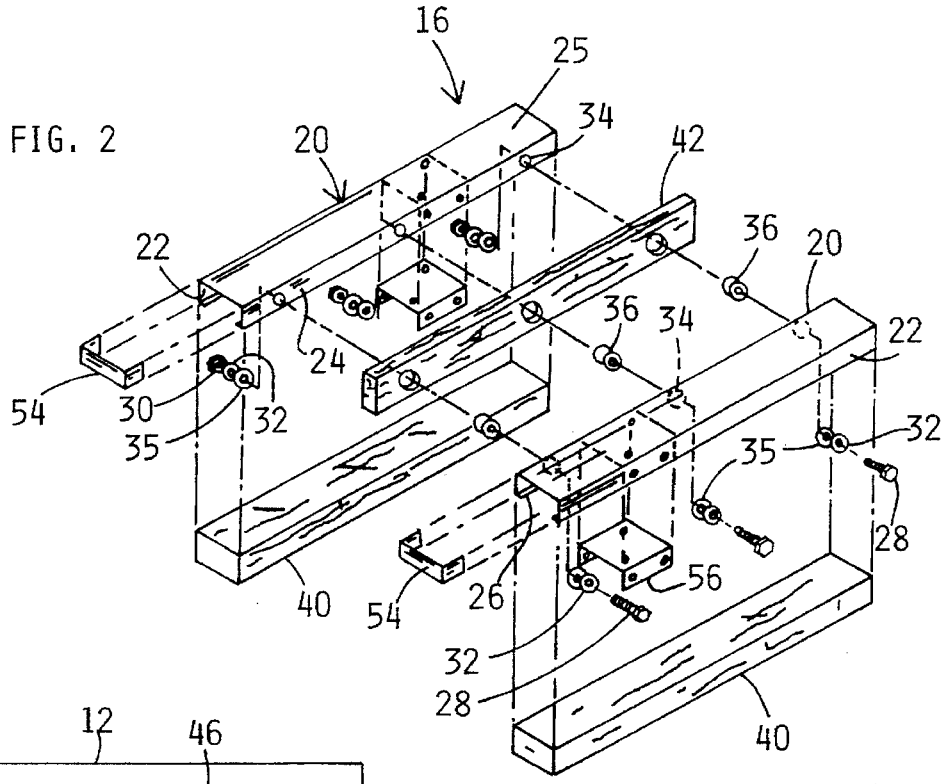
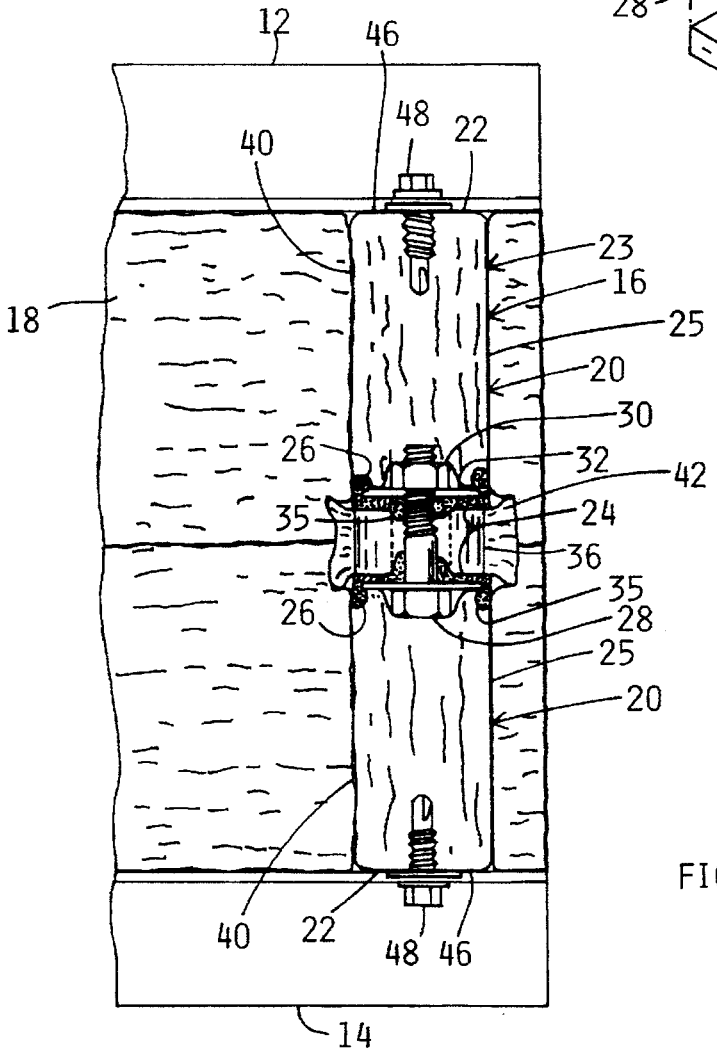
FIG. 3

BUILDINGS AND BUILDING COMPONENTS

This is a continuation-in-part of U.S. patent application Ser. No. 07/862,813 filed on Apr. 3, 1992.

TECHNICAL FIELD

This invention relates generally to construction materials, and specifically to modular building panels for use in buildings as walls, floors or roofs. The modular building panels disclosed herein can be used as or on either the exterior or the interior walls of buildings including roofs and floors. The panels of the present invention are particularly well suited for use for protection from fire, and from penetration of ballistic projectiles.

BACKGROUND OF THE INVENTION

At the present time, all states in the United States have a building code requirement that on certain commercial buildings, the exterior walls and roof must be constructed with noncombustible materials. When exposed to fire (1,700 degrees Fahrenheit (°F.)), materials used are to be noncombustible and not give off toxic fumes. In order to meet the requirement, the exterior of these buildings have been constructed with some or all of the following materials: concrete, brick, block, steel, and fire rated drywall. Blocks and/or steel studs make up the main body of these exterior walls, with brick veneer, stucco, or other finishing material applied to the exterior surface. Although the above named materials are noncombustible, nonmelting, and do not give off toxic fumes when exposed to fire, they are extremely poor insulators against the heat and cold. For instance, hollow concrete blocks (light aggregate) have the resistance (R) values as follows: 4-inch (4") block—R-1.11; 8-inch (8") block—R-1.72, and 12-inch (12") block—R-1.89. Even though the steel stud wall can be filled with thermal insulation, the steel stud itself will be a thermal conductor between the exterior and the interior of the building. Consequently, for these buildings to be habitable, these walls will require an additional thermal insulated wall or ceiling to protect the interior of the building from the heat of summer and the cold of the winter. When the concrete, brick, block, steel and fire rated drywall materials are used in exterior walls and roof area, they presently must all be built on site with expensive materials and field labor, thus maintaining high cost and adding time to the construction financing.

Further, the use of concrete blocks requires appropriate concrete footings and supports for the wall and foundation and attention to the weight of the materials, for example, the weight of hollow concrete blocks (light aggregate) must be considered in providing footings. A 4" block weighs 21 pounds per square foot, an 8" block weighs 38 pounds per square foot, and a 12" block weighs 55 pounds per square foot. This significant difference in square footage weight means the modular building panel requires less weight to be borne by the concrete footings and wall (foundation). The extra supports and footings add to the cost of the block walls.

Thus, a problem in the art is the construction of affordable buildings that meet code requirements. In addition to block and/or steel stud construction, the person of ordinary skill in the construction industry has attempted to solve the problem of providing affordable buildings in other ways. Some commercial buildings have been produced with a single metal skin. These buildings meet fire codes but have very high heating and cooling costs because there is little or no insulation. Other commercial buildings utilize steel framing, to which is applied 4" or 6" fiberglass insulation along with a metalized vinyl facing sheet, to the framing walls and roof. An exterior steel rib panel is applied using self drilling/self tapping stitching screws which drill a hole through the steel rib panel, through the insulation and fasten into the framing. Because of this procedure, every stitching screw that is fastened into the framing becomes a thermal conductor of cold and heat to the framing. In cold weather and with the interior heated, these cold areas on the framing will cause moisture and frost to form, damaging the insulation. Over a period of years, the moisture will cause the exterior steel rib panel to rust from the inside out.

Yet another insulation system is known to commercial contractors. This system allows the contractor to install 8" to 12" of insulation into the roof assembly. This insulation includes an interior metal skin, 8" to 12" insulation blocks, and the exterior metal rib skin. The system does eliminate the moisture and frost problem, but the drawback is that it must be applied to the roof area one piece at a time, adding construction costs to the roof area.

When a state building code designates building projects be built with exteriors of noncombustible materials, traditional building methods use masonry, hollow concrete blocks and/or steel studs as their main wall assembly and a steel roof system in these projects. Each of the conventionally produced wall systems requires a thermal insulated barrier wall between the main exterior walls and the interior of the building. This process adds cost and time to construction financing and the completion date. It will take two extra steps in scheduling and personnel to finish the exterior walls and attic ceiling: first a framing crew, to site build the barrier walls and ceiling; and second, an insulating crew to install the needed insulation.

Another approach to modular buildings employs sandwich panels. Prefabricated modular building panels, sandwich panels, generally are formed of a pair of spaced apart walls, surfaces, or skin sheets, having inserted therebetween some kind of insulating core material. In these conventional sandwich panels, the skin sheets bear all the loads and the core has an insulating function as well as the additional function of holding the facing skin sheets in spaced relationship under load. The core bears both tension and compression loads which are normal to the surfaces of the facing sheets. The structural loads imposed on the panels are borne almost totally by the skins. In recent years, a variety of foamed polymers (e.g., polyurethane and polystyrene) have been used as the insulating core material for such modular building panels. Various problems, however, have been encountered in the design and structure of modular building panels.

The majority of sandwich panels are produced by injecting an insulating foam product between the exterior and interior skins, or by gluing the exterior and interior skins to blocks of foam. This foam provides the necessary insulating properties. However, when the sandwich panels are exposed to fire, the foam melts, gives off toxic fumes and causes the exterior and interior skins to separate, thereby losing mechanical strength.

Another group of sandwich panels utilize subgirts in their construction. For sandwich panels using mineral wool as the insulation, the subgirts have been found to be made from fire rated drywall, fiberglass, plastic and steel. Sandwich panels using fire rated drywall as their subgirt do not have the mechanical integrity (strength) to support an exterior wall covering; consequently, their use is limited to interior fire rated walls. Sandwich panels that used fiberglass or plastic as their subgirt are noncombustible and do not give off toxic fumes when exposed to fire, but the subgirt melts causing the exterior and interior skin to separate. These panels must have fire rated drywall applied to the interior skin to maintain any integrity. Sandwich panels that use steel as their subgirt have the same problem as the steel stud wall. The steel subgirt becomes a thermal conductor of cold and heat, and needs an interior thermal insulated barrier wall next to the exterior wall. Thus, the industry has struggled to find ways to integrate, into a modular building panel, the combination of thermal insulation, mechanical strength for load bearing purposes desired for the panel, fire resistance and/or other desired properties.

There have been various prior art attempts to provide improved panels. For example, U.S. Pat. No. 4,641,469 issued to Wood teaches a modular panel made with polyurethane foam board or polystyrene foam board. Flanged rigidifying channels are inserted into the foam board by sliding them lengthwise into channels cut into, and extending across, the foam board. At the construction site, the board is attached to the building structural members by use of the rigidifying channels.

In U.S. Pat. No. 4,961,298 issued to Nogradi, "C-shaped" aluminum rigidifying channels are embedded into the foam board by transverse movement of the channels relative to the foam board, and are held to the board by adhesive. At the construction site, the board is glued to a substrate wall surface.

Both Wood and Norgadi teach using light-weight coatings on the board surface. Typical coatings are acrylic-based coatings or cementitious materials. Neither Wood nor Nogradi teach any reinforcing means extending between the two outer surfaces of the modular building panel. Accordingly, they are unable to provide any structural connection between the building structural members and the surfaces of the modular building panels which are disposed outwardly of the building. The panels of Wood and Nogradi lack the ability to secure heavy components, such as brick, on the outside surface of such modular panels to the structural members of the building, by connection through the elements of the modular panel. Accordingly, both the Wood and Nogradi panels lack mechanical strength. Neither do they offer a noncombustible insulating panel or protection from penetration of ballistic projectiles.

U.S. Pat. No. 4,837,999 issued to Stayner teaches a modular insulating panel made with a foam board core member, and having fiberglass-impregnated and/or filler-impregnated "C-shaped" or "H-shaped" thermoset resin pultrusions on opposing edges of the foam boards and extending between the inner and outer surfaces of the modular panel. The pultrusions in Stayner can perhaps provide a reinforcing connection between the building structural members and the outer surface of the building modular panels, while maintaining a reasonable thermal barrier between inner and outer surfaces of the modular panels at the pultrusions. But the polymer resin-based pultrusions inherently comprise a continuous-phase embedding polymeric material which receives the reinforcing fiberglass and/or any filler used. Accordingly, while the pultrusion may have a lower fire spread rate, it can contribute fuel to the burning of a fire. Of even greater concern, the polymer-based pultrusion can melt. Stayner makes no claim that his pultrusion is noncombustible or nonmelting. Rather, he suggests using noncombustible mineral wool for some or all of the core member of the modular panel, in order to reduce or eliminate combustibility of the core member. His only suggestion that offers elimination of the combustibility of the pultrusions is to replace the pultrusions with corresponding members made with metal. Stayner admits that such metal members would compromise the insulating value of the modular panels. He does not address the susceptibility of his polymer to melt. Stayner offers no mechanical reinforcing means and no bullet-proofing.

Thus, a persistent and vexatious problem in the art is the lack of a modular panel having the combination of good thermal insulation and mechanical load bearing properties, as well as maintenance of structural integrity during fire conditions; namely noncombustible and nonmelting properties, preferably including reinforcing connections between the building structural frame and the outer surface of the outer wall of the building. Neither does the art teach or suggest a light weight modular building panel offering substantial protection from penetration of ballistic projectiles. Despite recognition of these design problems, proper solutions to these problems have not been demonstrated in the art.

SUMMARY OF THE INVENTION

This invention provides modular building panels of a sandwich type for use in fabricating, for example, walls, floors and roofs of buildings. The panels, besides providing mechanical strength under load, typically are intended to protect the interior of the building from intrusion of heat and cold, from fire, and/or, in some embodiments, from small arms gunfire. The panels provide for structural loads borne substantially by the panel skins.

In a first embodiment, some aspects of the invention are obtained in a novel bridge girt assembly comprising first and second noncombustible, elongate brace members, each elongate brace member having an outer leg adapted to receive a modular building panel skin sheet thereon, and web means extending from each outer leg toward the other elongate brace member; and noncombustible, thermally insulating spacing means secured between the webs of the brace members; the noncombustible, thermally insulating spacing means providing a thermal break between the brace members, along the respective lengths thereof.

Preferably, the spacing means is substantially noncompressible along the dimension thereof which extends between the webs of the brace members. The bridge girt is attached between a pair of facing skin sheets. Air acts as an insulating core in the absence of a core panel means.

In preferred versions of this embodiment, the spacing means comprises a plurality of spacers disposed at spaced locations along the lengths of the brace members. Preferred spacers are comprised of ceramic material which is adapted to withstand the compressive force applied to the spacers by applying 32 foot pounds of torque on standard coarse-thread machine bolts and using that torque, applied to the machine bolts, to secure the spacers in the assembly by compression. The ceramic spacers are typically secured between the webs of the brace members by connectors having negligible thermal insulating value. Where it is desired to ensure an effective thermal break, washers are placed between the connectors and the webs of the brace members, the washers being thermally insulating and noncombustible, and being compressible when assembled into the bridge girt assembly.

In preferred versions of the bridge girt assembly, the brace members can have cavities extending along their respective lengths, and insulation, preferably noncombustible insulation, can be disposed in the cavities.

The invention comprehends modular building panels, made with the above bridge girt assemblies of the first embodiment. A respective panel has a length, a width, and a thickness, and comprises a core panel means having edges and opposing major surfaces extending between the edges; first and second ones of the above bridge girt assemblies on opposing ones of the edges of the core panel means, the outer legs of the bridge girt assembly defining opposing outer surfaces adapted to receive inner and outer skin sheets of the modular panel; and inner and outer skin sheets extending across the major surfaces of the core panel means and secured to the first and second bridge girt assemblies at their opposing outer surfaces, such that the core panel means is disposed and secured between the inner and outer skin sheets and the first and second bridge girt assemblies.

Preferably, the core panel means and the skin sheets consist essentially of noncombustible materials, whereby the modular building panel is noncombustible, and the building panel has an overall insulating value of at least R2, preferably at least R3, per inch thickness of the core panel means.

In a second embodiment of bridge girt assemblies and modular building panels made therefrom, the bridge girt assembly comprises first and second elongate brace members, each elongate brace member having an outer leg adapted to receive a skin sheet thereon, and web means extending from each outer leg toward the other brace member; and a plurality of thermally insulating spacers, spaced from each other and secured between the web means, and thereby securing the first and second brace members to each other, the thermally insulating spacers, as assembled in the bridge girt assembly, providing a thermal break between the first and second elongate brace members.

As in the first bridge girt embodiment, the spacers are preferably substantially noncompressible, and comprise the above-described ceramic spacers secured between the webs by the above connectors having negligible thermal insulating value, the bridge girt assembly including the above thermally insulating, noncombustible washer means which is compressible when assembled into the bridge girt assembly.

In a third embodiment, the invention comprises a modular building panel, comprising a pair of facing skin sheets arranged with adjacent edges generally extending parallel to, and spaced apart from, one another, and defining a length and a width, and a space between the facing skin sheets; core panel means in the space between the facing skin sheets, and generally coextensive with the facing skin sheets along the length and width; and a ceramic felt disposed between the core panel means and one of the facing skin sheets, and coextensive with the respective facing skin sheet along the length and width thereof.

In some versions, and wherein the skin sheets are noncombustible and the panel is susceptible, if the core panel means is not protected, of failing to provide a one-hour fire rating if constructed without the ceramic felt element, the failure susceptibility being primarily a function of the combustibility of the core panel means, such as where the core panel means is fiberglass or foam. The ceramic felt provides protection to such core panel means whereby the fire rating is improved. In some versions, the resulting building panel can meet the requirements for a one-hour fire rating or for a rating higher than one-hour fire rating.

The bridge girt assemblies disclosed herein can be used as desired, in making the modular building panels of this third embodiment.

In a fourth embodiment, the invention comprehends a modular building panel comprising a pair of facing skin sheets arranged with adjacent edges generally extending parallel to one another, the facing skin sheets being spaced from each other by spacing means interposed and secured between the facing skin sheets, the spacing means including a plurality of noncompressible ceramic spacers adapted to withstand sufficient compression to secure them in position between the facing skin sheets, such as the above 32 foot pounds of torque on standard coarse thread machine bolts.

Preferably, the skin sheets consist essentially of noncombustible material, and the building panel includes core panel means disposed in the space between the facing skin sheets, the core panel means consisting essentially of material having sufficient fire retardant properties that the building panel has at least a one-hour fire rating.

In some versions of this fourth embodiment, the core panel means, too, consists essentially of noncombustible materials, whereby the modular building panel is noncombustible.

In a fifth embodiment, the invention comprehends a modular building panel comprising a pair of facing skin sheets arranged with adjacent edges generally extending parallel to, and spaced apart from, one another, and defining a length, a width and a space between the facing skin sheets; and core panel means in the space between the facing skin sheets, and generally coextensive with the facing skin sheets along the length and width, the core panel means comprising a nonmetallic, and nonsheet glass, bullet-proofing layer generally coextensive with the facing skin sheets and adapted to stop projectiles from small arms gunfire, whereby the modular building panel is bullet-proof.

The modular building panels of this fifth embodiment preferably include bridge girt assemblies comprising first and second noncombustible, elongate brace members, each elongate brace member having an outer leg secured to one of the facing skin sheets, and web means extending from each outer leg toward the other brace member; and noncombustible, thermally insulating spacing means secured between the webs of the elongate brace members; the noncombustible, thermally insulating spacing means providing a thermal break between, and along the respective lengths of, the first and second elongate brace members. The ceramic spacers are preferably secured between the webs of the elongate brace members by connectors having negligible thermal insulating value, and washers are disposed between the connectors and the webs of the brace members, the washers being thermally insulating and noncombustible, and being compressible when assembled into the bridge girt assembly. Where the skin sheets consist essentially of noncombustible materials, the modular building panel is both bullet-proof and noncombustible. Where the core panel means also includes an insulating board generally coextensive with the skin sheets between the bridge girt assemblies, the modular panel also provides thermal insulation. Preferably, the insulating board is noncombustible, whereby the noncombustible properties of the modular panel can be achieved.

The invention further comprehends buildings made with all the above modular building panels including use of these panels as walls, floors and roofs.

One advantage of the present invention is the provision of a thermally insulating and fire resistant bridge girt assembly for use with a modular building panel to provide mechanical strength to the panel under load and wind condition.

A further advantage of the present invention is the provision of a modular building sandwich panel utilizing a bridge girt assembly, the panel being designed to have combined mechanical strength, fire resistance and thermal insulating properties.

Yet another advantage of the present invention is the provision of a modular building panel which is useable to form roofs, exterior walls and floors of a modular building structure.

Another advantage of the present invention is the provision of a light weight building panel structure which has mechanical reinforcing, bullet-proofing, insulating, and fire resistant properties.

Still another advantage of the present invention is the provision of low cost, modular buildings utilizing lightweight modular building panels which can be used for exterior load bearing walls, floors and ceilings.

Yet another advantage of the present invention is the provision of a modular building panel having a bridge girt assembly that maintains its integrity when exposed to fire such that the panel skins do not separate.

Still yet another advantage of the present invention is the provision of a low cost modular building panel which requires less structural framing of the building in which the panel is employed.

Other advantages and a fuller appreciation of the features of the present invention will become readily apparent from the following detailed description of the invention, from the claims, and from the accompanying drawings.

BRIEF DESCRIPTION OF THE DRAWINGS

The preferred exemplary embodiments of the present invention will hereinafter be described in conjunction with the appended drawings, where like designations denote like elements; and:

FIG. 2 is an exploded view of the bridge girt assembly;

FIG. 3 is a fragmentary cross-section of the modular building panel taken at 3—3 of FIG. 1 and showing a cross-section of the bridge girt assembly;

DETAILED DESCRIPTION

Figure 1:
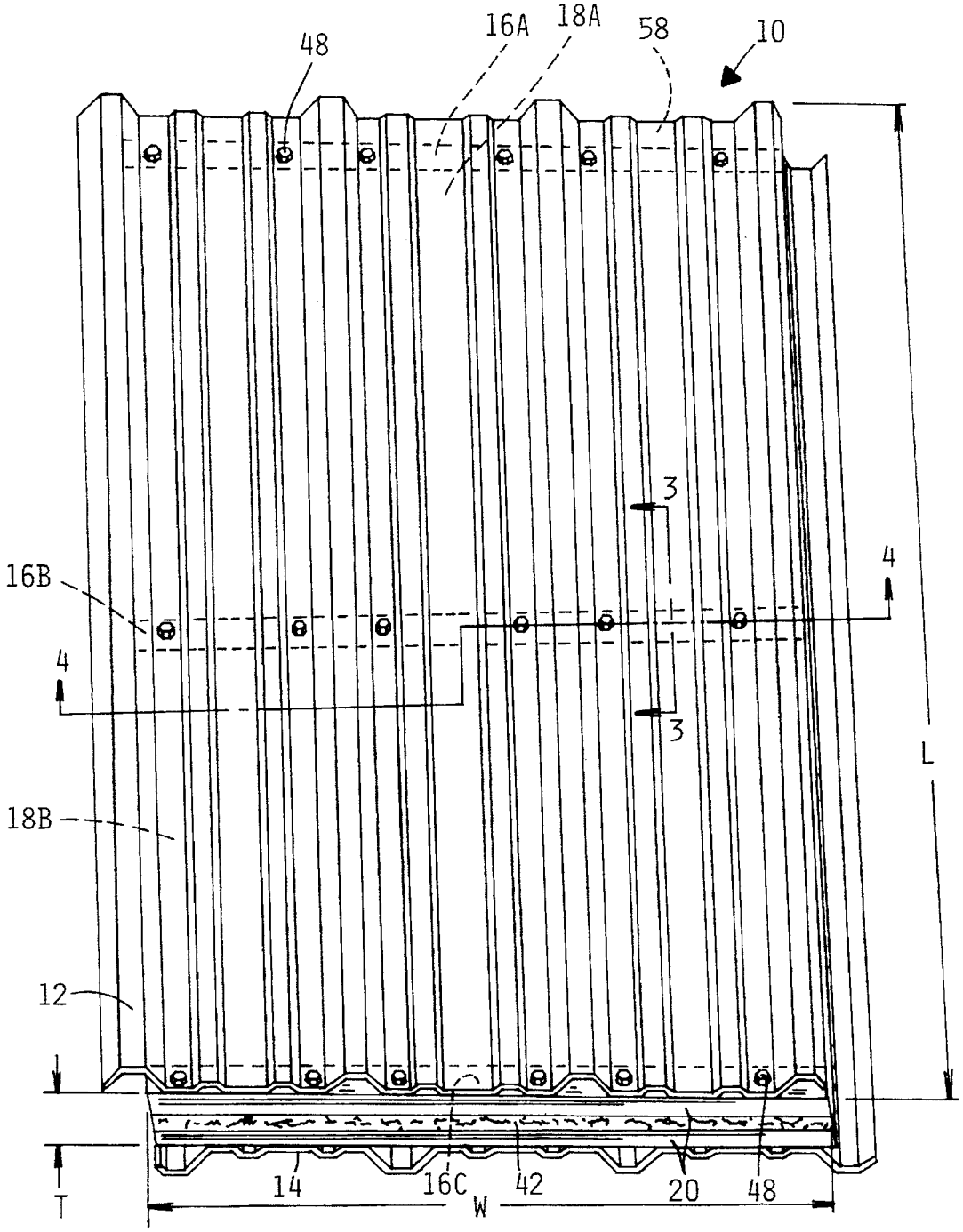
FIG. 1 is a pictorial view of a modular building panel of this invention.

Referring now to FIG. 1, the modular building panel 10 has a length "L," a width "W," and a thickness "T," and generally comprises an outer skin sheet 12, an inner skin sheet 14, and a plurality of bridge girt assemblies 16 extending across the width "W" of the panel. A first core panel member 18A is disposed between bridge girt assemblies 16A and 16B. A second core panel member 18B is disposed between inner and outer skin sheets 12 and 14 and between bridge girt assemblies 16B and 16C. Preferably, the core panel members 18 are lightly compressed between inner and outer skin sheets 12 and 14, whereby modest expansive restorative forces in the core panel members push outwardly against inner and outer skin sheets 12 and 14, and, thus, fix the core panel members in position.

As seen in FIGS. 2 and 3, each bridge girt assembly 16 comprises a pair of elongate C-shaped channel braces 20, which are preferably constructed of metal. Each channel brace has an outer leg 22, and a web 23. As illustrated, each web 23 comprises an inner leg 24, a back wall 25, and a lip 26 opposite back wall 25. The channel braces 20 are bolted together by bolts 28, nuts 30, and metal washers 32, through holes 34 in inner legs 24. Thermally insulating washers 35 are disposed between washers 32 and legs 24 of the respective braces 20. Thermally insulating spacers 36, preferably ceramic, are interposed between the channel braces 20 at each bolt 28.

L-Grade steatite insulators have high compression strength with low thermal conductivity. For example, grade L-3A, steatite insulators available from DU-CO Ceramics Company, Saxonburg, Pa., are suitable as spacers 36. Typical such spacers are, for example, 1.173 inches outside diameter and 0.5 inch thick, and have a 0.5-inch diameter hole. The grade L-3A steatite insulator has a tensile strength of 8,000 to 12,000 pounds per square inch and a compression strength of 70,000–90,000 pounds per square inch. This L-grade steatite insulator is also shatter resistant. By shatter resistant, we mean that when the elongate members, if made of 20-gauge steel are heated red hot, to about 1,700° F., this steatite insulator spacer does not shatter when sprayed with a stream of cold water when the spacer is employed in the bridge girt assembly. By cold water, we mean water temperatures used in extinguishing fires in building or housing structures.

Thermally insulating washers 35 are made using, for example, a wet ceramic felt which is flexible when wet, and which forms a more rigid/less flexible mat when dry. A suitable such wet ceramic felt is available as RPC-2300-W, available from Refractory Products Company, Elgin, Ill. The felt is kept wet, and therefore flexible, until installed in the position shown in FIG. 3, between conventional metal washer 32 and the leg 24 of the brace 20. As the nut 30 is tightened on bolt 28 and washer 32, the felt under washer 32 is compressed, and is thereby deformed around the outer edge of washer 32 as shown; and is also similarly deformed into the hole 34, whereby the felt is thus disposed between bolt 28 and the edge of the hole 34. The deformed wet ceramic felt thus is disposed, and acts, much like a grommet which is set into a hole so as to protect the inner circumference of the hole. When the wet ceramic felt dries in the bridge girt assembly, it generally holds its shape, thus becoming washer 35. The resulting felt washer 35 is noncombustible, being ceramic, and provides thermal insulation between the brace 20 and the bolt, nut, and washer, 38, 30, 32. Similarly-operative textile ceramic material is also likely useful, and operative embodiments thereof are included herein within the definition of the thermally insulating, noncombustible washer 35.

One feature of the bridge girt assembly is it s thermally insulating property. The combination of thermally insulating washers 35 and thermally insulating spacers 36 thus advantageously provides an effective thermal break between the channel braces 20, and accordingly between the inner and outer skin sheets 12 and 14.

A second advantageous property of the bridge girt assembly 16 is that all of its elements (namely the channel braces 20, spacers 36, bolts 28, nuts 30, and washers 32 and 35) are noncombustible, whereby the rib assembly in its entirety is noncombustible.

A third advantage of bridge girt assembly 16 is that its elements can be combined in a variety of sizes and strengths. Accordingly, the bridge girt assembly, and cooperatively the modular building panel made with it, can be made as mechanically strong as desired by specifying the strengths of the several components. The bridge girt assembly and the resultant panel can be made thick or thin (dimension "T"), as desired to accommodate thermal insulation materials or other materials.

Figure 5:
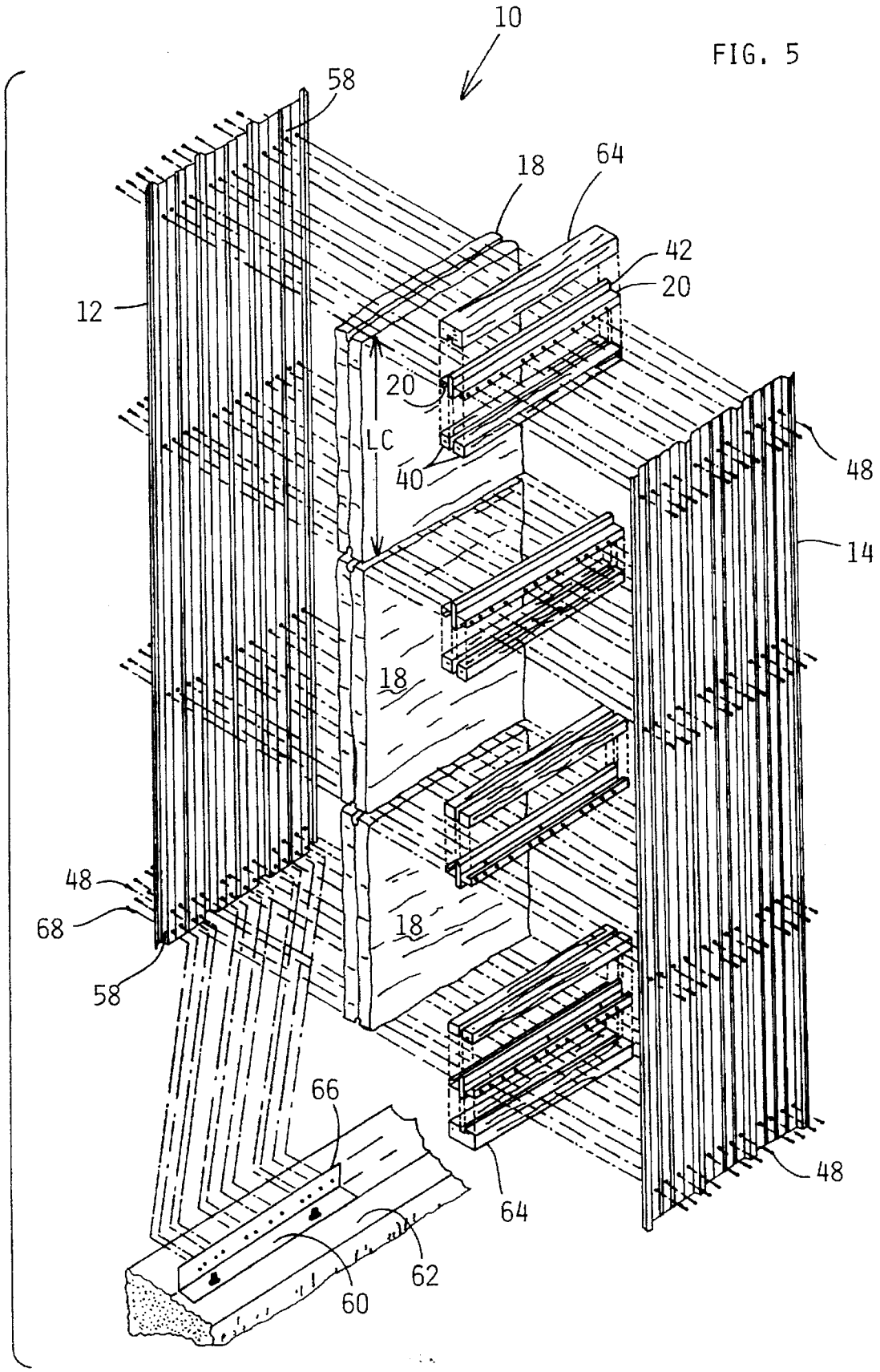
FIG. 5 is an exploded view of a modular building panel, and a fragment of a building foundation.

Each channel brace 20 is preferably filled with a cooperatively shaped block 40 of insulating material which is preferably lightly compressed. Another cooperatively shaped block 42 of the insulating material receives spacers 36 as shown, and is disposed between the inner surfaces of inner legs 24 of the channel braces 20. The core panel members 18 generally fill the spaces between the inner and outer skin sheets, and the bridge girt assemblies. As illustrated in FIGS. 3 and 5, the core panel members 18 are lightly compressed into, and fill, the spaces between the bridge girt assemblies, conforming to internal surface irregularities, especially at the rib assemblies.

The core panel members 18 and the insulating blocks 40 and 42 provide the primary insulating properties of the wall panels 10. Mineral wool, because of its noncombustible property, is the preferred material for the core panel members 18 and insulating blocks 40 and 42. A variety of insulating mineral wool products are available, and can be selected for their differing properties as desired. Illustrative of suitable mineral wool products are the panels sold as Rocboard™ by Partek Insulation Inc., Sarnia, Ontario, Canada. Such boards have 100% recovery after 10% compression, whereby their recovery properties are readily used to fix and hold the boards in position as core panel members 18, as described above.

Another mineral wool product is the bulk ceramic fiber sold as Kaowool™ by Thermal Ceramics, Inc., Augusta, Ga. These and similar mineral-derived fibrous products are included in the term "mineral wool."

As used herein, throughout, including in the claims, the term "noncombustible" means that the primary structure being addressed will not burn under ordinary building casualty-fire conditions, whereby the structural integrity of the structure addressed is not reduced in an ordinary building casualty fire. Coatings such as paint or anti-rust coatings and the like may burn, but their burning typically adds only a little fuel and does not imperil the structural integrity of the assembly. Of course, where a building is being addressed, other components of the building not related to the modular building panels are not being addressed.

As used herein, throughout, including in the claims, the term "one-hour rated" means a material or structure which passes the burning test set forth in ASTM E-119.

As used herein, the term "bullet proof" as related to a wall panel means that the wall panel prevents penetration, through both skin sheets, of ballistic projectiles having the penetrating power of a .44 magnum caliber handgun fired at close range.

As used herein, the term "nonmelting" refers to a panel whose components do not melt under the conditions to which the panel is exposed when tested according to ASTM E-119, and which panel maintains its integrity under those conditions.

Generally, the test conditions of ASTM E-119, as referred to herein, provide heat, in a furnace, on one side of the building panel, at a scheduled rate of increase in temperature. When the opposing skin reaches 250° F., above its initial temperature (in at least one hour, and up to eight hours), the panel is pulled out of the furnace. A stream of water from a pipe generally 2.5 inches diameter, equipped with 1.125-inch tip, at 30–45 pounds per square inch gauge pressure is then impinged on the burned side of the panel from about 20 feet away. If water penetrates the skin on the unburned side of the panel, namely demonstrating burn-through of the entire thickness of the panel, the panel fails the test. If water does not penetrate the skin on the unburned side, the panel passes the test, and is rated according to the amount of time the panel was subjected to the fire in the furnace before the side disposed away from the heat reached 250° F. above its initial temperature. Of course, if the panel members or components melt, integrity of the panel is not maintained, and the panel, accordingly, fails the test.

The amount of thermal resistance provided by the wall panels 10 is generally determined by the thickness of the core panel members 18. The preferred Rocboard™ material has an insulating value of R4 per inch thickness at the typically preferred density of 4 pounds per cubic foot. It is available in thicknesses from 1 to 5 inches, in 0.5-inch increments and a variety of densities. Typical core panel members 18 are between two and eight inches thick. So a wall panel having a core member 5.5 inches thick, having two Rocboard™ panels, one 2.5 inches thick and one 3.0 inches thick, density 4 pounds per cubic foot, and constructed as illustrated in the drawings (e.g., FIG. 5), with the bridge girt assemblies positioned 4 feet apart, has a theoretical insulating value of R22, assuming that the insulating value of the bridge girts is the same as the insulating value of the Rocboard™. Fully assembled, the modular building panel of the claimed invention weighs about six (6) pounds per square foot. Allowing a lesser insulation value for the bridge girts, the modular building panel will have an R-value representing thermal resistance in the range of about R16 to about R19. Such a building panel, 3 feet wide and 20 feet long, assembled as in the illustrated embodiments, and secured with the preferred torque on bolts 28, can withstand a single span wind loading of up to at least about 88 pounds per square foot, based on the skin sheets and the screw fasteners selected. This corresponds to a wind speed of over 200 miles per hour.

The thicknesses of the respective bridge girt assemblies can be varied such that the bridge girt assemblies accommodate the thicknesses of the core members, by using different size C-channels.

The cross-sectional shapes and thicknesses of braces 20 are not critical so long as the braces provide structural web 23 members corresponding at least to back walls 25, the webs extending sufficiently inwardly toward the respective opposing braces that, e.g., the webs can be used to secure the braces to each other. A preferred brace is the C-channel as shown, made with 20-gauge steel.

Inner and outer skin sheets 12 and 14 are secured to opposing outer surfaces 46 of the outer legs 22 of C-channels 20, of bridge girt assembly 16, by screws 48 which extend through the respective skin sheets and the respective ones of the outer legs 22. The modular building panel of the present invention is fastened to the building's frame by stitching the interior skin of our modular building panel to the building's framework, eliminating any thermal transfer of exterior weather condition through the panels.

Figure 4:
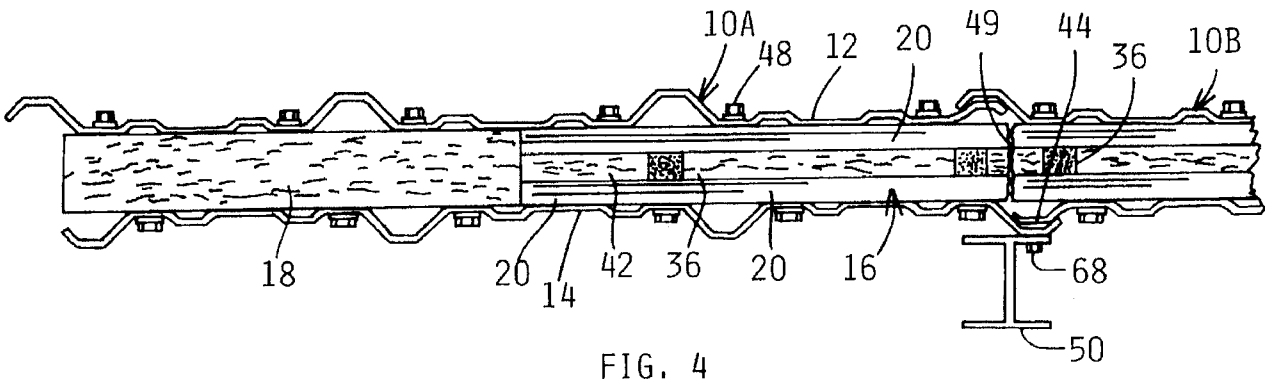
FIG. 4 is a cross-section taken at 4—4 of FIG. 1, showing the modular panel of FIG. 1 coupled to a second panel, only part of which is shown in FIG. 4.

As seen in FIGS. 1, 4 and 5, inner and outer skin sheets are preferably ribbed or corrugated sheet metal or the like. At least 26-gauge sheet steel is used, with 26-gauge sheet steel being preferred. FIG. 4 shows the overlap of the skin sheets of adjacent panels 10A and 10B, as the skin sheets provide the main closure at the joint 49 between the adjacent panels, the joint being represented by the meeting of the core panel members 18, the bridge girt assemblies 16, and the skin sheets 12 and 14. Where the outer skin sheet 12 is to form an outer surface of the roof of a finished building, sealing tape 44 provides a seal between the overlapped skin sheet portions, as shown. However, by securing holding straps and the like (not shown) through outer skin sheet 12 to the bridge girt assemblies 16, a variety of other facing materials may be secured to the outer surfaces of the modular building panels to form the outer surface of the building; such heavy materials as brick and natural stone being included.

Inner and outer skin sheets 12 and 14 can have a variety of shapes, and can be made from a variety of materials well known in the art for surfaces of building wall panels. Thus, outer skin sheet 12 can be made with a fiberglass impregnated plastic resin, or other plastic, sprayed on cementitious mixture, and the like. The inner skin can be one of the plastics or mineral coatings, or other covering well known in the art. Where fire resistance properties are desired, as in some of the embodiments herein, noncombustible skin sheets are preferred, such as the above mentioned sheet steel.

The wall panels 10 can be made in a variety of lengths and widths by selecting different dimensions for the core panel members 18, the bridge girt assemblies 16, and the inner and outer skin sheets 12 and 14. The modular panels can also be made longer or shorter by adding or deleting sections, each section comprising a core panel member 18 and a corresponding bridge girt assembly. Inner and outer skin sheets 12 and 14 are, of course, sized accordingly. FIGS. 1 and 5 illustrate modular panels having two and three core panel members 18 respectively.

Either of skin sheets 12 or 14 can accept additional finishing layers, not shown. For example, gypsum can be used on inner skin sheet 14. Brick can be used on outer skin sheet 12 as indicated (supported by a brick ledge on the foundation). Other conventional exterior surface products can also be used on outer skin 12, such as prefabricated cementitious panels 52. A wire mesh can be anchored to the exterior sheet and stucco can be applied to the mesh.

As disclosed for the illustrated embodiment, all elements of the wall panels 10 are preferably noncombustible materials. This provides a noncombustible construction, which will maintain its integrity under fire conditions. Where a one-hour fire rating using the ASTM E-119 test conditions is acceptable, materials having corresponding potential for burning may be used. The tolerance for burning governs the selection of materials. The selection will be obvious to those of ordinary skill in the art. Thus, in embodiments which need not be fire rated, the channel braces 20 and spacers 36 can be, for example, plastic. The core panel members, and blocks 40 and 42, can be foamed plastic. But the fire rated (at least one-hour rating) and fire proof (four-hour rating) constructions are preferred. Fire resistance requirements are thus considered when the component of the modular building panel are selected.

Figure 6:
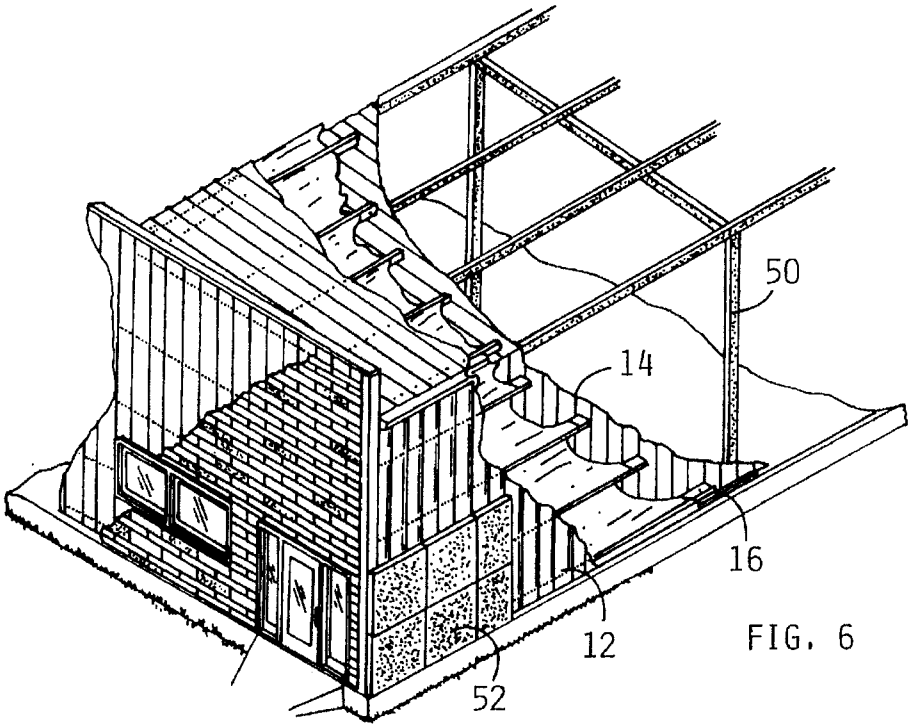
FIG. 6 is a pictorial view of a fragment of a building, with parts cut away, made with modular building panels of this invention.

As illustrated in FIG. 6, the modular building panels disclosed herein can be used in either vertical or horizontal orientations, and at any angle in between.

The modular building panels of this invention can be used in all types of commercial buildings as: exterior and interior walls, fire rated party walls, curtain walls, floor and roof systems. The type of buildings that would use these products are: apartment projects, office buildings, hospitals, clinics, libraries, schools, motels, airport hangars, heated warehouses, manufacturing facilities, foreign housing, public and private security systems.

End caps 54 and braces 56 are used as needed in channel braces 20 for increased structural rigidity and support in the bridge girt assemblies. The end caps 54 can also be used as closures for bridge girt assemblies that form ends of walls or wall surfaces in the building.

Referring now to FIGS. 2 and 3, the bridge girt assembly is assembled as follows. Braces 56, if used, are inserted into channel braces 20, as illustrated in FIG. 2, and are secured in place by screws, pop rivets or the like. Spacers 36 are inserted into the holes in insulation block 42. Legs 24 of the braces 20 are positioned on opposing sides of insulation block 42 and, correspondingly, on opposing ends of the spacers 36, with the respective holes 34 in the legs 24 aligned with each other and with the holes in spacers 36. Standard coarse-thread machine bolts (preferably grade 5) are fitted with washers 32. Ceramic felt material, preferably including a properly punched hole for receiving bolt 28, is placed on the bolts. The bolts, with the two washers, are inserted through the holes 34 and the spacers 36. Ceramic felt material is again fitted onto the bolts, followed by metal washers 32 and nuts 30. 5/16-inch standard coarse thread bolts and nuts are preferred. As the nuts are tightened, the felt washer material is compressed and deformed around the metal washers 32 and into the holes 34 in the metal inner legs 24 of the braces 20.

The structural rigidity of the bridge girt assembly is determined, in part, by the tightening force applied at nuts 30. The tightening also encourages the flow of the flexible ceramic felt material into holes 34 and around washers 32 as discussed above. Nuts 30 are preferably tightened to a torque of 32 to 40 foot pounds, 36 foot pounds torque being preferred.

Blocks 40 of insulating material, preferably the same composition as core panel members 18, are then inserted into the braces, in the positions shown in FIG. 3. End caps 54 are then inserted, if used. The bridge girt assembly 16 is thus complete and ready for use in a modular building panel.

With reference to FIGS. 1, 3, and 5, the assembly of a modular building panel is now illustrated, assuming that the assembling of the bridge girt assemblies has been completed. First the bridge girt assemblies are secured, at their outer surfaces 46, to one of the skin sheets 12 and 14 using screws 48; leaving space to receive the core panel members 18 between the bridge girt assemblies when the core panel members are lightly compressed along their lengths "LC" (e.g. up to about 10% of the length). The core panel members 18 are then positioned in the spaces, each panel member having one of its major surfaces disposed against the respective skin sheet. The opposing edges of the core panel member are disposed against the respective bridge girt assemblies. The compression of the resilient core panel members when they are inserted into the space causes the core panel members to exert a modest expansive restorative force against the bridge girt assemblies (see FIG. 3) whereby the core panel member 18 is deformed/conformed about any irregularities in the corresponding surface of the bridge girt assembly. Note in FIGS. 3, 7, and 8, how the core panel members 18 conform especially to block 42, whereby the core panel members are readily fixed in position. With the core panel members in position, the second skin sheet is placed over the combination of the bridge girt assemblies and the core panel members, and secured to the bridge girt assemblies using more screws 48. This completes the assembly of the modular panel prior to shipping to the building site. Spaces 58 are disposed between the ends of the panel and the outermost bridge girt assemblies in FIG. 5. Spaces 58 are filled with blocks of insulation 64 at the building site.

Rocboard™ panels, one 2.5 inches thick and one 3.0 inches thick, with a density of 4 pounds per cubic foot; thermally insulating spacers 36, L-3A steatite insulators (DU-CO Ceramics Co.); bolts with hex nut, 5/16 inch ×1.5 inch yellow zinc steel; and screws, 7/8 inch self-tapping stitching screws.

As can be seen in Table I, for a single span 8 foot building panel, the allowable superimposed live and dead load is 296 PSF and the allowable wind load is 402 PSF. This is far superior to those advertised for similar currently marketed building panels. For example, a single 8 foot span of the Patentech Corp., Sugar Grove, Ill., twin wall panel R-PB5, which is also constructed of two 26 gauge steel corrugated outer skins and a 5 inch mineral wool core, has an allowable superimposed live and dead load of 136 PSF and allowable

TABLE I

| ALLOWABLE LOADS (P.S.F.) | LOAD CONDITION - LIMITED BY DEFLECTION @ L/240 | | | | | | | | | | | | | |
|---|---|---|---|---|---|---|---|---|---|---|---|---|---|---|
| LOAD CONDITION (Single Span) | SPAN CONDITION "L" IN FEET | | | | | | | | | | | | | |
| <_____> | 6' | 8' | 10' | 12' | 14' | 16' | 18' | 20' | 22' | 24' | 26' | 28' | 30' | 32' |
| span <panel length> | 6' | 8' | 10' | 12' | 14' | 16' | 18' | 20' | 22' | 24' | 26' | 28' | 30' | 32' |
| Single Span - Superimposed Live and Dead Load | 397 | 296 | 236 | 162 | 100 | 65 | 44 | 30 | 21 | 15 | | | | |
| Single Span - Wind Load | 536 | 402 | 290 | 168 | 106 | 71 | 50 | 36 | 27 | 21 | 16 | | | |
| LOAD CONDITION (Double Span) | SPAN CONDITION "L" IN FEET | | | | | | | | | | | | | |
| <_____> | 6' | 8' | 10' | 12' | 14' | 16' | 18' | 20' | 22' | 24' | 26' | 28' | 30' | 32' |
| span span <---panel length---> | 12' | 16' | 20' | 24' | 28' | 32' | 36' | 40' | 44' | 48' | 52' | 56' | 60' | 64' |
| 2-Span - Superimposed Live and Dead Load | 155 | 115 | 91 | 74 | 63 | 54 | 48 | 42 | 38 | 34 | 31 | 28 | 26 | 24 |
| 2-Span - Wind Load | 214 | 161 | 128 | 107 | 92 | 80 | 71 | 64 | 58 | 53 | 49 | 46 | 43 | 40 |
| LOAD CONDITION (Triple Span) | SPAN CONDITION "L" IN FEET | | | | | | | | | | | | | |
| <_____> | 6' | 8' | 10' | 12' | 14' | 16' | 18' | 20' | 22' | 24' | 26' | 28' | 30' | 32' |
| span span span <---panel length---> | 18' | 24' | 30' | 36' | 42' | 48' | 54' | 60' | 66' | 72' | 78' | 84' | 90' | 96' |
| 3-Span - Superimposed Live and Dead Load | 329 | 246 | 195 | 162 | 138 | 120 | 106 | 95 | 85 | 78 | 71 | 68 | 61 | 57 |
| 3-Span - Wind Load | 446 | 335 | 268 | 223 | 191 | 167 | 149 | 134 | 122 | 112 | 103 | 96 | 89 | 84 |

*Superimposed loads do not include the weight of the panel.

The unique combination and arrangement of the structural components of the building panels provides unexpectedly superior load bearing capacities. In Table I, the calculated allowable loads in pounds per square feet (PSF) for the building panels of various spans and lengths are given. The allowable load is the weight (PSF) that, when evenly distributed over the panel, will cause the panel to deflect L/240 feet, where L is the span of the panel in feet. Thus for an 8 foot panel, the allowable load would be the weight that would cause the panel to deflect 8×12/240 or 0.4 inches. For a 20 foot panel, it would be the weight that would cause the panel to deflect 1 inch.

The parameters of the building panel components that were used to calculate the loads were as follows: Corrugated skin sheets 12 and 14, 0.02 inch thick 26 gauge steel; C-channels 20, 20 gauge steel; core panel members 18, two wind load of 185 PSF (L/240). These allowable loads are under half that allowed by the panels of the present invention. Not surprisingly, currently marketed single skin corrugated metal panels, such as those sold by McElroy Metal, Inc., Bossier City, La., have been less structural strength. McElroy's 24 foot panel having 2 bearing points spaced 8 feet apart made of 0.02 inch thick 26 gauge, ribbed steel sheets (80 Fy KSI) has an allowable wind load of only 17 PSF at L/180 (deflection 0.53 inches). This is compared to an allowable wind load of 335 PSF for our triple span 24 foot panel at L/240 (deflection 0.4 inches).

Under, for example, the Wisconsin Administrative Code for wind loads, "[e]very building (including all components of the exterior wall) and structure shall be designed to resist a minimum total wind load" of 20 PSF for buildings up to 50 feet in length. See Wis. Admin. Code § [ILHR] 35.12(1)

(March 1991). As can be seen from Table I, single span panels up to 24 feet in length, in accordance with the present invention, meet this specification.

At the building site, an angle iron adapter 60 or the like is secured to the building foundation 62. Just prior to installation of the modular panel on the building, insulation blocks 64 are placed into spaces 58. With blocks 64 in place, the modular panel 10 is set into place on the adapter 60, with the upper edge 66 of the adapter 60 between inner and outer skin sheets 14 and 12, and adjacent one of the skin sheets, preferably between outer skin sheet 12 and the lower insulation block 64. Screws 68 are then installed through the adjacent skin sheet (skin sheet 12 in the drawings) of the wall panel 80 and adapter 60 at the base of the wall panel 80 (FIG. 5) and through inner skin sheet 14 and structural frame members 50 (FIG. 4). This secures the modular building panel to the building.

Figure 9:
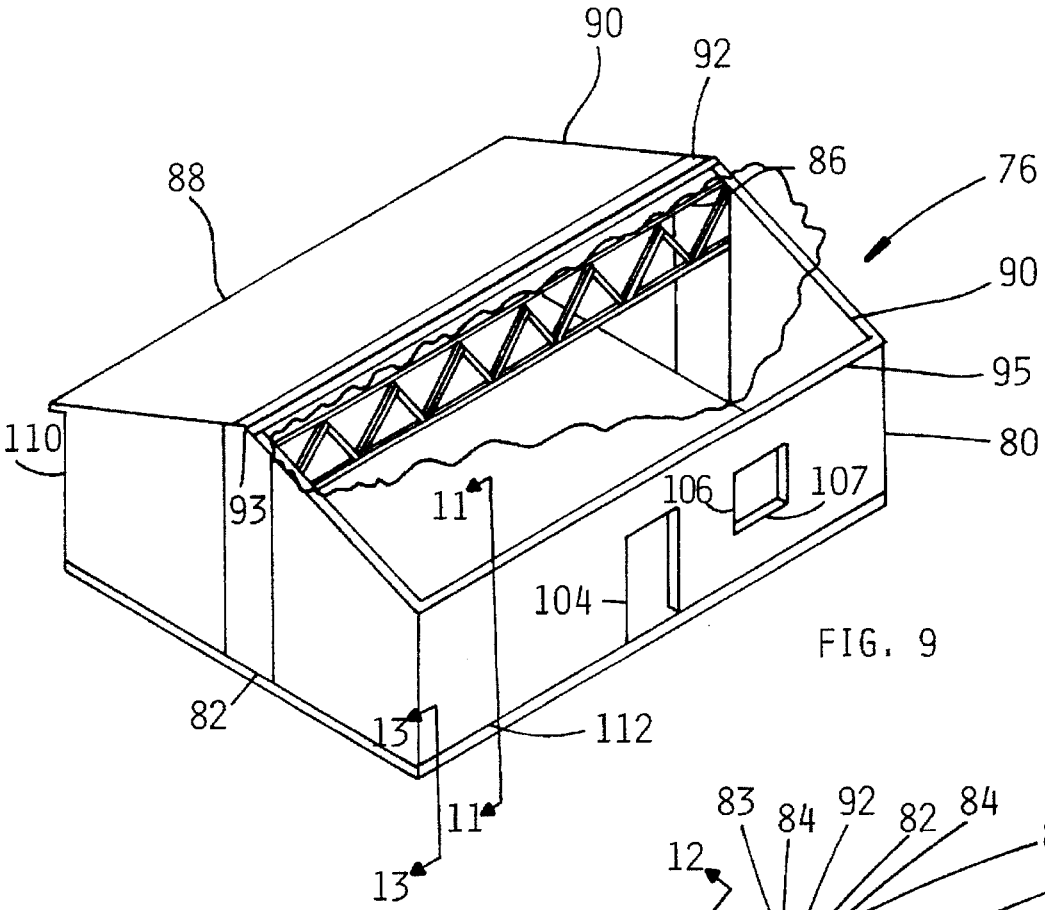
FIG. 9 is a pictorial view of a dwelling, with parts cut away, made with the modular building panels of this invention.
Figure 10:
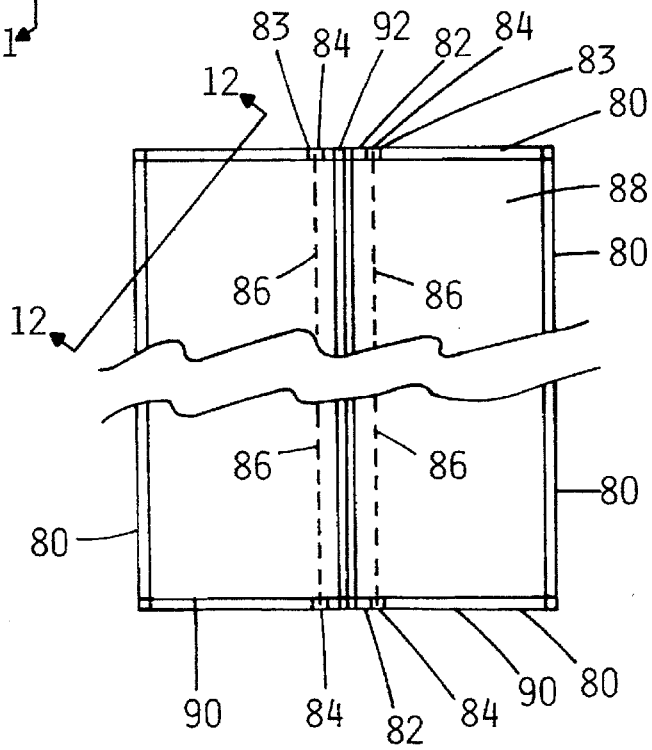
FIG. 10 is a top plan view of a dwelling made with the modular building panels of this invention showing the vertically oriented bridge girt assemblies of the bar joist support wall panel.
Figure 11:
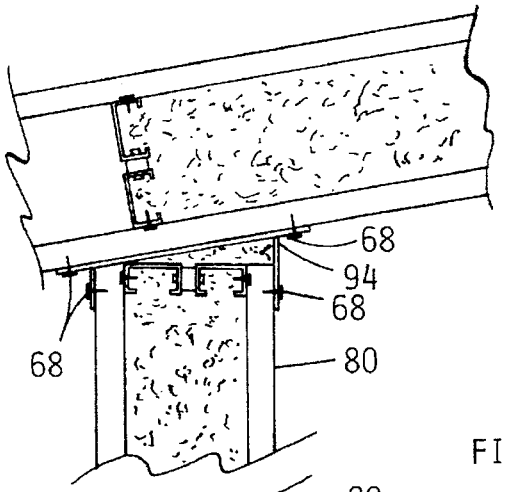
FIG. 11 is a fragmentary cross-section taken at 11—11 of FIG. 9 showing the connection of wall panels with roof panels and floor panels of this invention.

In certain applications floor panels 78 may be used where a second floor or third floor is needed in the building. Floor panels 78 may also be used for single story dwellings 76 as shown in FIG. 9. Local building codes govern the requirements for additional structural members for the floor. In these situations, or in a dwelling 76 with a crawl space having a concrete foundation member 119 as shown in FIG. 11, the floor panels 78 are fixed to a floor panel adapter ledge 85, and/or to said wall panels 80, and/or floor framing (not shown). Adapter 85 has a first portion 131 for fixedly attaching to floor panel 78 and an upper edge 130 for fixedly attaching to the wall panel 80. Appropriate fasteners such as screws 68 are used. Where a concrete crawl space is used in the building foundation, a conventional building plate 120 is used to affix the floor panel adapter ledge 85 to the floor panel 78. A second building plate 121 is fastened to the concrete foundation member 119 using a masonry fastener 118. The floor panel 78 is affixed to the building plate 121. The wall panel 80 is fastened to the floor panel adapter ledge 85 preferably with the upper edge 130 of floor panel adapter ledge 85 between the inner 14 and outer 12 skin sheets and a corner insulation block 64. Screws 68 are installed through the adjacent skin sheet (skin sheet 14 in the drawings) of the wall panel 80 and floor panel adapter ledge 85 at the base of the wall panel 80 (FIG. 11) and through the skin sheet 14 and structural frame members 50 (not shown).

The wall panels 80 are attached to the frame members 50 as shown on FIG. 5. The structural loads borne on the wall panel 80 are borne almost totally by the skins 12, 14.

As best shown in FIGS. 5, 9, 10, 11 and 12 for use in dwellings 76 such as for the low income housing market, the modular building panel 10 is modified to include a bar joist support wall panel 82 having two additional vertically oriented bridge girt assemblies 84 running parallel to the panel length L and located at the panel edges 83. These bridge girt assemblies 84 are constructed as previously described bridge girt assemblies 16, but assemblies 84 are oriented in the vertical direction. The assemblies 84 are essentially perpendicular to assemblies 16. Each of these two vertically oriented bridge girt assemblies 84 is connected at one end to the bar joist 86 of the roof 88, and at the other end to the adapter 60 at the foundation, as shown in FIGS. 5 and 13, or to member 85 in the case of a multi-story building or a building having a crawl space. The vertically oriented bridge girts 84 provide further structural support to the gabled roof 88. Alternatively small structural support beams (not shown) may be used in lieu of the vertically oriented bridge girt assemblies. A connection roof cap 92 is placed over the roof joint 93 where the inclined roof panels 90 meet.

As shown in FIG. 11, the wall panels 80 along the perimeter 95 of the dwelling 76 are fastened to a metal roof carrier 94 which runs along the perimeter 95 of the structure 76. The roof panels 90 are also fastened to the roof carrier 94.

Figure 12:
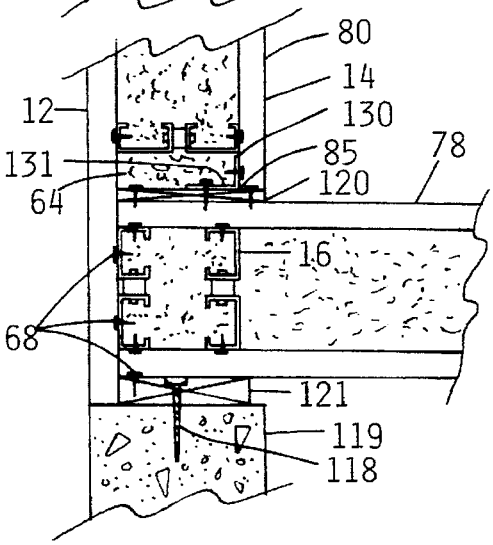
FIG. 12 is a fragmentary cross-section showing the connection of the joining dwelling walls.
Figure 12:
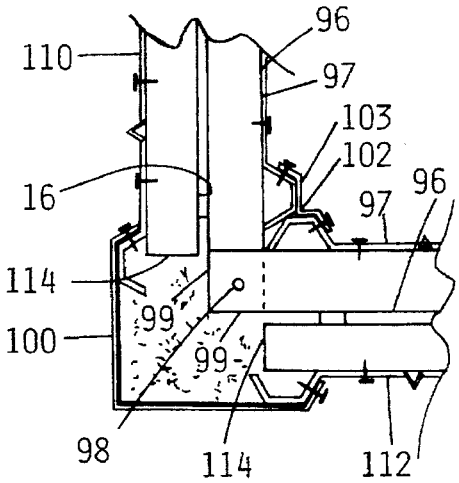
Figure 13:
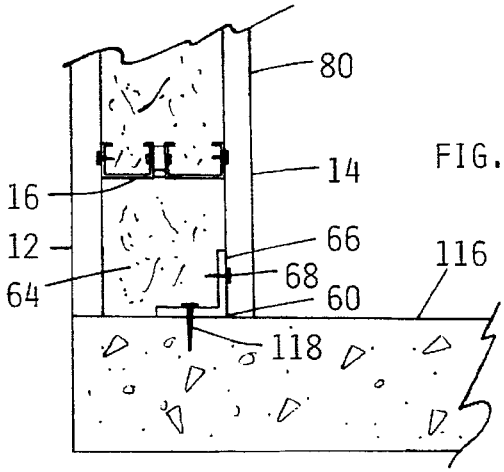
FIG. 13 is a fragmentary cross-section taken at 13—13 of FIG. 9 showing an alternative connection of the wall panels to a concrete floor.

As shown in FIG. 12, where the dwelling walls 110, 112 are joined one to another, corner joiner wall panels 97 are used. The corner joiner wall panels 97 have the previously described wall panel 80 design but one of the elongate brace members 96 in the wall panels 97 to be joined is modified to be hingedly attached by member 98 to an adjacent elongate brace member 96 of the adjoining wall panel 97. Each of these panels 97 has an elongate brace member 96 which has a portion 99 which extends outwardly from the panel edges 114 of panel 97. This is best shown in FIG. 12. A corner cap 100 is placed over the external face of wall joint 102 to protect the wall joint 102 of the building from moisture and insects or other vermin. An interior fastening member 103 is used to connect the outer sheets 12 of the corner joiner wall panels 97 to each other. The corner cap 100 is filled in the field with added insulation.

As shown in FIG. 13 where a concrete floor 116 is used, in either the modular building structure or in the dwelling 76, the adapter 60 is joined by a conventional masonry fastener 118 to the concrete floor 116. The wall panel 80 is affixed to the adapter 60, and to the frame 50 in the same manner as previously described for fixing wall panel 80 to adapter 85 and as shown in FIG. 11.

In addition, the panel 10 could be oriented so that the bridge girt assemblies 16 of the present invention run along the door jamb 104 and/or along vertical frame element 106 of the window 107 of the building 76. Or a panel 10 could be fabricated incorporating an additional bridge girt assembly generally perpendicular to the other bridge girt assemblies 16 and disposed parallel to a panel edge. Also, bridge girt assemblies 16 could run in the vertical dimensions entirely when disposed in a building.

Because of the mechanical strength and the load properties of the building panel 10, fewer purlins are required in the framing. This becomes important in localities where framing materials are scare or expensive or where labor construction costs are high. The panels 10 can be attached to steel frame members, thereby conserving on expensive wooden materials in certain localities.

Each core panel member 18 can be comprised of a single block of material (e.g., Rocboard™), or can be two layers, as shown, in FIG. 5, or more.

Figure 7:
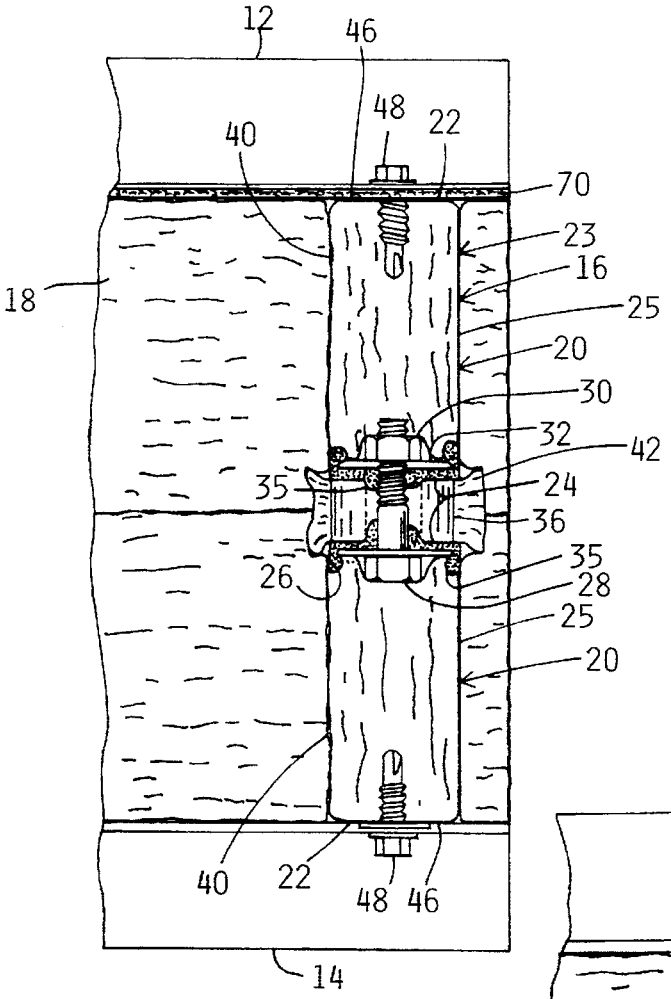
FIGS. 7 and 8 are fragmentary cross-sections as in FIG. 3, showing exemplary optional structuring on the interior of the modular building panels.

In FIG. 7, a layer 70 of noncombustible insulation is placed between the inner skin sheet 12 and the core panel member 18 and is coextensive with the inner skin sheet. The wet ceramic felt material (e.g. RPC 2300-W) used for washers 35 is a suitable material. Ceramic textiles may also be used. This construction, using a noncombustible layer, can be advantageous when a more combustible material such as fiberglass or a polymeric foam composition is selected for use in the core panel member 18. Layer 70 serves as a fire shield to protect the core panel member, whereby the fire resistance of the overall modular building panel may be improved.

Figure 8:
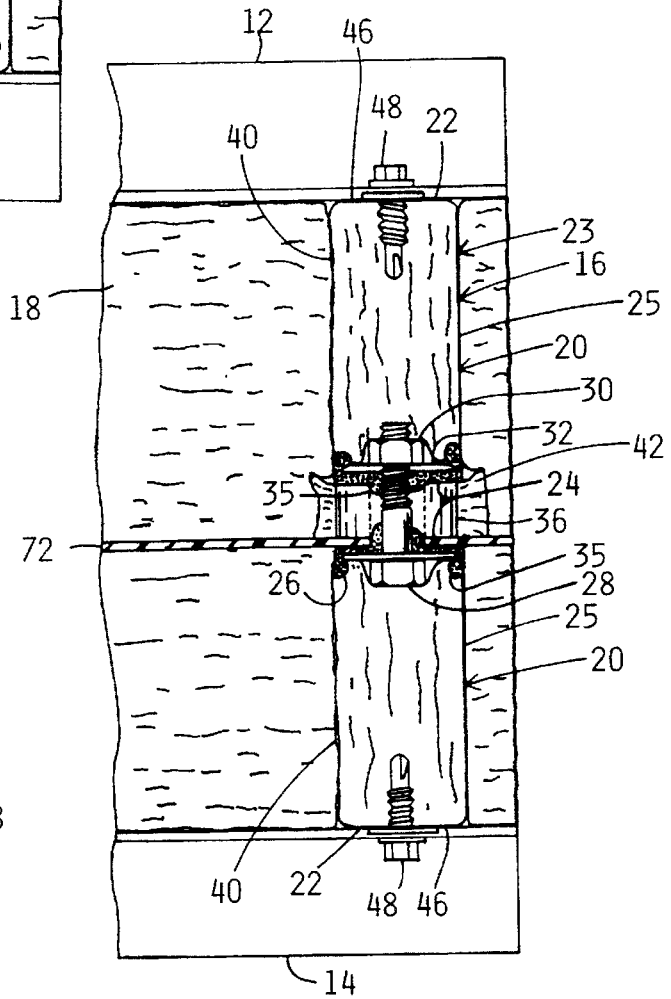

In FIG. 8, a bullet-proofing layer 72 of a nonmetallic, preferably polymeric, bullet-proofing material is secured between ceramic spacers 36 and the inner legs 24 on the braces 20 on one side of the spacers 36. Bullet-proof metal sheet or glass sheet are not used because they are heavy and more difficult to work with. The layer 72 may contain glass and/or metallic components, but not as continuous phase coextensive with the layer such that the continuous phase provides, by itself, the primary bullet-proofing property. So, as used herein, "nonglass" means not glass as a continuous phase. Accordingly, "nonglass" excludes from layer 72 conventional plate glass and sheet glass as ordinarily associated with bullet-proof glass installations. Similarly, "nonmetallic" means not metal as a continuous phase. Accordingly, "nonmetallic" excludes from layer 72 conventional metal plate strong enough to prevent ballistic penetration. However, "nonglass" and "nonmetallic" does not exclude from layer 72 a metal layer or a glass layer of lesser barrier property as one of a plurality of layers in a multiple layer barrier corresponding to layer 72, which lesser metal and glass layers are hereby included in the definition of layer 72 as a bullet-proof layer where layer 72 comprises a plurality of layers. From the above, it can be seen that layer 72 may comprise a multiple layer structure having a plurality of sub-layers joined to each other, generally in face-to-face relationship, and which sub-layers act, in combination, to provide the bullet-proof property.

A variety of suitable bullet-proofing materials are known, such as Kevlar™ and the like. Kevlar™, an aramid fiber, is a trademarked product of DuPont for an aromatic polyamide polymer fiber, poly(1,4-phenyleneterephthalamide). Such materials are light-weight, and are suitable for stopping small arms gunfire, whereby the entire building made with such building panels can be made bullet proof. Layer 72 can readily be located elsewhere in the panel structure, if desired, such as between outer skin sheet 14 and the core panel member 18. The weight of a modular building panel having a bridge girt assembly and about 5.5 inches of Rocboard™ material is about 6 pounds per square foot, with the KEVLAR™ layer the weight is under 8 pounds per square foot, thus affording a light weight panel which is easier to use as compared to conventional bullet-proof building panels.

The use of a bullet-proof layer in a building becomes important in areas of urban crime or in countries experiencing civil unrest where sniper fire from small arms may be an everyday experience. Also, this modular building panel may provide a measure of protection in offices or businesses in crime infested areas and also in places such as police stations, court houses, gasoline stations, convenience stores, currency exchanges, pawn shops, and the like.

In a combination modular building panel, the bullet-proofing layer 72 can be used in combination with insulating mineral wool core panel members 18 and noncombustible bridge girt assemblies. The resulting modular panels are both noncombustible and bullet proof. The bullet-proofing layer can also be used with the embodiment of FIG. 7, comprising the overall ceramic layer, whereby the core panel member 18 is generally not noncombustible, and perhaps not fire rated, but is protected by noncombustible layer 70. These structures, too, offer both bullet resistance and resistance to fire.

In addition, the modular building built with applicants' invention is more cost effective than techniques known in the art. The lightweight properties of the panel mean that less building costs will be allocated to the extra supports and footings needed for conventional block walls. Since the panels can be factory fabricated with excellent insulating ratings, there is no need to have extra framing and insulating work done on site. Fewer purlins and similar other structural members are needed because of the improved load bearing capabilities, thereby reducing material and labor costs. The panels require no wooden structures and can be applied to metal framing members, thereby saving costs where wooden materials are scarce and frequently expensive.

Also the modular building built with the bridge girt assemblies using Grade L-3A steatite insulator are safer under fire conditions. During a fire, when water is applied to the building to extinguish the fire, the preferred spacer will not shatter and will not cause the panel to lose its structural integrity. This provides the fire fighter or victim with an added measure of safety in or around a building which is on fire.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

We claim:

1. A bridge girt assembly for use within a modular building panel, said bridge girt assembly comprising:

(a) first and second noncombustible, elongate brace members, each said elongate brace member having an outer leg having an outer surface, said outer surface configured to receive a modular building panel skin sheet thereon, and a web extending from each said outer leg toward the other said elongate brace member;

(b) fastening means for connecting said elongate brace members one to another; and (c) noncombustible, thermally insulating spacing means, secured by said fastening means between each said web of said elongate brace members, for providing thermal insulation between said outer legs; said noncombustible, thermally insulating spacing means providing a thermal break between said first and second elongate brace members;

wherein said spacing means is substantially noncompressible along the dimension thereof extending between said webs, said spacing means having sufficient mechanical properties to prevent shattering when said spacing means is heated to a temperature of about 1,700 degrees Fahrenheit and said spacing means is sprayed with cold water.

2. A modular building structure comprising:

(a) a plurality of load bearing panels, said plurality including wall panels and roof panels, each of said panels comprising (i) a pair of spaced apart, facing skin sheets arranged with adjacent edges extending substantially parallel to one another, and having a length and a width;

(ii) a plurality of bridge girt assemblies, each said bridge girt assembly disposed therebetween said facing skin sheets and extending across the width of said facing skin sheets, and connecting said skin sheets, each said bridge girt assembly spaced from each other and from the edges defining the length of said facing skin sheets, each said bridge girt assembly including (A) first and second noncombustible, elongate brace members, each said elongate brace member having an outer leg having an outer surface, said outer surface receiving a modular building panel skin sheet thereon, and a web extending from each said outer leg toward the other said elongate brace member; (B) fastening means for connecting said brace members one to another; and (C) noncombustible, thermally insulating spacing means, secured by said fastening means between said webs of said elongate brace members, for providing thermal insulation and a thermal break between said first and second elongate brace members; and (iii) a core panel disposed therebetween said facing skin sheets, and substantially coextensive with said facing skin sheets along said length and width, said core panel further disposed between a pair of bridge girt assemblies, (b) a structural member forming a modular building frame, said structural member adjacent one of said facing skin sheets and secured to said facing skin sheet; and (c) an adapter secured to a modular building foundation, said adapter having an upper edge, said upper edge of said adapter disposed between said pair of facing skin sheets and adjacent one of said facing skin sheets, said adapter secured to said adjacent facing skin sheet;

wherein said wall panels are disposed vertically on said adapter, said wall panels having said wall panel bridge girt assemblies substantially parallel to said adapter, and said roof panels spanning certain of said wall panels and being supported by said wall panels and by said structural member.

3. The modular building structure of claim 2, wherein ends of said panels are disposed adjacent one another, forming a plurality of adjacent panels, and further comprising a panel joint between said adjacent panels, said panel joint formed by the meeting of said core panels, said bridge girt assemblies, and said skin sheets of said adjacent panels, and said panel joint further having an overlap portion wherein, for adjacent panels, a portion of one of said skin sheets overlaps a portion of said skin sheet in said adjacent panel.

4. The modular building structure of claim 3, wherein said panel joint further comprises a sealing tape disposed between said overlap portion of said adjacent skin sheets of roof panels, wherein said adjacent skin sheets of said roof panels form an outer roof surface of a finished building.

5. A modular building structure as in claim 2, wherein said core panel and said facing skin sheets comprise noncombustible materials, each said panel having an overall insulating value of at least R3 per inch thickness of said core panel, and each said panel further comprising a nonmetallic, nonglass bullet-proofing layer disposed between said skin sheets and substantially coextensive with said facing skin sheets, said bullet-proofing layer having an impact strength sufficient to stop projectiles from small arms gunfire, whereby said building structure is noncombustible, fire resistant and bullet-proof and further wherein said panel weight is about 8 pounds or less per square foot.

6. The modular building structure of claim 2, wherein said facing skin sheets are noncombustible and said spacing means is noncombustible, thermally insulating and shatter-proof when said panel reaches a temperature of about 1,700 degrees Fahrenheit and said spacing means is sprayed with a cold water spray, wherein spacing of said facing skin sheets and structural integrity and stability of said panel is maintained.

7. The modular building structure of claim 2, wherein said plurality of panels further comprises a floor panel, said floor panel fixedly attached to said modular building frame.

8. A modular building panel, comprising (a) a pair of spaced apart, facing skin sheets arranged with adjacent edges extending substantially parallel to one another, and having a length and a width; and (b) a bridge girt assembly disposed therebetween said facing skin sheets and extending across the width of said facing skin sheets, and connecting said skin sheets, said bridge girt assembly spaced from the edges defining the length of said facing skin sheets, said bridge girt assembly comprising:

(i) first and second noncombustible elongate brace members, each said elongate brace member having an outer leg having an outer surface, said outer surface receiving a facing skin sheet thereon, and a web extending from each said outer leg toward the other said elongate brace member;

(ii) fastening means for connecting said elongate brace members to one another; and (iii) noncombustible, thermally insulating spacing means, secured by said fastening means between said webs of said elongate brace members, for providing thermal insulation between said outer legs; said noncombustible, thermally insulating spacing means providing a thermal break between said first and second elongate brace members;

said bridge girt assembly being intermittently secured at said outer surfaces of said outer legs opposite said spacing means to said facing skin sheets.

9. The modular building panel of claim 8, wherein said facing skin sheets are fabricated of a corrugated sheet metal having longitudinally ribbed portions, and said bridge girt assembly is disposed substantially perpendicular to said ribbed portions.

10. The modular building panel as in claim 8, further comprising a core panel disposed therebetween said facing skin sheets, and substantially coextensive with said facing skin sheets along said length and width and disposed against said bridge girt assembly.

11. A modular building panel as in claim 10, wherein said core panel comprises fiberglass.

12. A modular building panel as in claim 10, wherein said core panel comprises mineral wool.

13. The modular building panel as in claim 12, wherein said facing skin sheets have longitudinally ribbed portions and wherein said fastening means comprise standard coarse-thread machine bolts, said spacing means of said bridge girt assembly comprises a ceramic spacer having a compressive strength sufficient to withstand a compressive force applied to said spacer by applying a torque of 36 foot pounds to said standard coarse-thread machine bolts and using the torque applied to said machine bolts to secure said spacer to said webs in said assembly by compression, wherein said modular building panel having a 3 foot width by a 20 foot length can withstand a single span wind loading of at least about 20 pounds per square foot with a length/240 deflection of about one inch.

14. The modular building panel of claim 13, wherein said modular building panel can withstand a wind loading of up to about 88 pounds per square foot.

15. The modular building panel of claim 10, further comprising ceramic felt disposed between said core panel and one said facing skin sheet, and coextensive with said facing skin sheet along said length and width thereof.

16. A modular building panel as in claim 15, wherein said skin sheets are noncombustible, and wherein said ceramic felt provides sufficient fire resistance to said core panel such that said modular building panel meets a one-hour fire rating, said modular building panel being susceptible to failing to provide a one-hour fire rating without said ceramic felt.

17. A modular building panel as in claim 10, wherein said modular building panel meets at least a one-hour fire rating.

18. The modular panel of claim 8, further comprising a light weight bullet-proofing layer, said bullet-proofing layer disposed between said facing skin sheets, and substantially coextensive with said facing skin sheets along said length and width, said bullet-proofing layer including a nonmetallic, nonglass layer having an impact strength sufficient to stop projectiles from small arms gunfire, whereby said modular building panel is bullet-proof.

19. The modular building panel of claim 18, wherein the bullet-proofing layer comprises an aramid fiber and wherein said panel having said bullet-proofing layer has a weight of about 8 pounds or less per square foot.

20. The modular building panel as in claim 10, wherein said fastening means comprise standard coarse thread machine bolts, wherein said spacing means comprises a plurality of noncompressible ceramic spacers, each said ceramic spacer having a spacer hole, said ceramic spacers disposed at spaced locations along the lengths of said first and second elongate brace members, said ceramic spacers being secured between said webs of said elongate brace members by said standard coarse thread machine bolts, each of said bolts threaded into said spacer hole, said bolts having negligible thermal insulating value, and including a washer between said bolts and said web of said elongate brace members, said washer being thermally insulating and noncombustible, and being compressible when assembled into said bridge girt assembly, each said ceramic spacer having a compressive strength sufficient to withstand a compressive force applied to said ceramic spacers by applying 36 foot pounds of torque on said bolts and using the torque applied to said bolts to secure said spacers in said assembly by compression, said modular building panel providing thermal insulation corresponding to at least R2 per inch thickness of said core panel.

21. A modular building structure comprising:

(a) a plurality of load bearing panels, said plurality including wall panels and roof panels, each of said panels comprising (i) a pair of spaced apart, facing skin sheets arranged with adjacent edges extending substantially parallel to one another, and having a length and a width;

(ii) a plurality of bridge girt assemblies, each said bridge girt assembly disposed therebetween said facing skin sheets and extending across the width of said facing skin sheets, and connecting said skin sheets, each said bridge girt assembly spaced from each other and from the edges defining the length of said facing skin sheets, each said bridge girt assembly including (A) first and second noncombustible, elongate brace members, each said elongate brace member having an outer leg having an outer surface, said outer surface receiving a modular building panel skin sheet thereon, and a web extending from each said outer leg toward the other said elongate brace member; (B) fastening means for connecting said brace members one to another; and (C) noncombustible, thermally insulating spacing means, secured by said fastening means between said webs of said elongate brace members, for providing thermal insulation and a thermal break between said first and second elongate brace members; and (iii) a core panel disposed therebetween said facing skin sheets, and substantially coextensive with said facing skin sheets along said length and width, said core panel further disposed between a pair of bridge girt assemblies, (b) a structural member forming a modular building frame, said structural member adjacent one of said facing skin sheets and secured to said facing skin sheet; and (c) an adapter secured to a modular building foundation, said adapter having an upper edge, said upper edge of said adapter disposed between said pair of facing skin sheets and adjacent one of said facing skin sheets, said adapter secured to said adjacent facing skin sheet;

wherein said wall panels are disposed vertically on said adapter, said wall panels having said wall panel bridge girt assemblies substantially parallel to said adapter, and said roof panels spanning certain of said wall panels and being supported by said wall panels and by said structural member; and (d) a pair of bar joist structural members for inclining and supporting said roof panels, and a bar joist support wall panel for supporting both said bar joist structural members, said bar joist support wall panel including a pair of vertically oriented bridge girt assemblies disposed at the opposite edges of said bar joist support wall panel, said vertically oriented bridge girt assemblies substantially perpendicular to said other bridge girt assemblies within said bar joist support wall panel, each said vertically oriented bridge girt assembly fixedly attached to one of said bar joist structural members and to said adapter.

22. A modular building structure comprising:

(a) a plurality of load bearing panels, said plurality including wall panels and roof panels, each of said panels comprising (i) a pair of spaced apart, facing skin sheets arranged with adjacent edges extending substantially parallel to one another, and having a length and a width;

(ii) a plurality of bridge girt assemblies, each said bridge girt assembly disposed therebetween said facing skin sheets and extending across the width of said facing skin sheets, and connecting said skin sheets, each said bridge girt assembly spaced from each other and from the edges defining the length of said facing skin sheets, each said bridge girt assembly including (A) first and second noncombustible, elongate brace members, each said elongate brace member having an outer leg having an outer surface, said outer surface receiving a modular building panel skin sheet thereon, and a web extending from each said outer leg toward the other said elongate brace member; (B) fastening means for connecting said brace members one to another; and (C) noncombustible, thermally insulating spacing means, secured by said fastening means between said webs of said elongate brace members, for providing thermal insulation and a thermal break between said first and second elongate brace members; and (iii) a core panel disposed therebetween said facing skin sheets, and substantially coextensive with said facing skin sheets along said length and width, said core panel further disposed between a pair of bridge girt assemblies, (b) a structural member forming a modular building frame, said structural member adjacent one of said facing skin sheets and secured to said facing skin sheet; and (c) an adapter secured to a modular building foundation, said adapter having an upper edge, said upper edge of said adapter disposed between said pair of facing skin sheets and adjacent one of said facing skin sheets, said adapter secured to said adjacent facing skin sheet;

wherein said wall panels are disposed vertically on said adapter, said wall panels having said wall panel bridge girt assemblies substantially parallel to said adapter, and said roof panels spanning certain of said wall panels and being supported by said wall panels and by said structural member; and (d) corner joiner wall panels, wherein said corner joiner wall panels are joined to form abutting corners of said modular building structure, each of said corner joiner wall panels having a modified elongate member extending outwardly from said panel edges, said modified elongate member hingedly attached to a corresponding modified elongate member from said abutting corner joiner wall panel.

23. A modular building panel, comprising:

(a) a pair of spaced apart, facing skin sheets arranged with adjacent edges generally extending parallel to one another, and having a length and a width; and (b) a plurality of bridge girt assemblies disposed therebetween said facing skin sheets and extending across the width of said skin sheets, and connecting said skin sheets, said bridge girt assemblies spaced from the edges defining the length of said sheets and from each other, each of said bridge girt assemblies comprising:

(i) first and second elongate brace members, each said elongate brace member having an outer leg having an outer surface, said outer surface receiving a facing skin sheet thereon, and a web extending from each said outer leg toward the other said elongate brace member, each said web further having a back wall and an inwardly extending web portion extending sufficiently inward toward the respective opposing brace member to permit said first and second brace members to be secured to each other;

(ii) fastening means for connecting said elongate brace members to one another, said fastening means comprising standard coarse-threaded machine bolts; and (iii) a plurality of thermally insulating noncompressible ceramic spacers, each said ceramic spacer having a spacer hole, said ceramic spacers spaced from each other along the lengths of said elongate brace members and providing a thermal break between said first and second elongate brace members, said ceramic spacers being secured between said webs of said elongate brace members by said standard coarse-thread machine bolts penetrating through said spacer holes, said bolts having negligible thermal insulating value, said bolts including a washer disposed between said bolts and said webs of said elongate brace members, said washer being thermally insulating and noncombustible, and being compressible when assembled into said bridge girt assembly, said ceramic spacers having a compressive strength sufficient to withstand a compressive force applied to said spacers by applying a torque of 36 foot pounds to said standard coarse-threaded machine bolts and using the torque applied to said machine bolts to secure said ceramic spacers in said assembly by compression.

24. A bridge girt assembly for use within a modular building panel, said bridge girt assembly comprising:

(a) first second noncombustible, elongate brace members, each said elongate brace member having an outer leg having an outer surface, said outer surface configured to receive a modular building panel skin sheet thereon, and a web extending from each said outer leg toward the other side elongate brace member:

(b) fastening means for connecting said elongate brace members one to another; and (c) noncombustible, thermally insulating spacing means, secured by said fastening means between each said web of said elongate brace members, for providing thermal insulation between said outer legs; said noncombustible, thermally insulating spacing means providing a thermal break between said first and second elongate brace members;

wherein said spacing means comprises a plurality of spacers disposed at spaced locations along the lengths of said first and second elongate brace members, said spacing means providing a complete thermal break between said first and second elongate brace members; wherein said fastening means comprises standard coarse-thread machine bolts and wherein said spacers are noncompressible ceramic spacers having a compressive strength sufficient to withstand compressive force applied to said spacers by applying a torque of 36 foot pounds to said standard coarse-thread machine bolts and using the torque applied to said machine bolts to secure said spacers to said webs in said assembly by compression.

25. A bridge girt assembly as in claim 24, said machine bolts having negligible thermal insulating value, and further including washers between said machine bolts and said webs of said elongate brace members, said washers being thermally insulating and noncombustible, and being compressible when assembled into said bridge girt assembly.

* * * * *